United States Patent [19]

Arold

[11] Patent Number: 4,466,245

[45] Date of Patent: Aug. 21, 1984

[54] POWER PLANT HAVING A FLUID POWERED FLYWHEEL

[76] Inventor: Frank G. Arold, 145 Hillcrest Blvd., Ypsilanti, Mich. 48197

[21] Appl. No.: 500,260

[22] Filed: Jun. 2, 1983

[51] Int. Cl.[3] ..... F01D 1/18; F03B 3/00; F16H 43/00

[52] U.S. Cl. ..... 60/415; 60/325; 415/80; 416/20 R

[58] Field of Search ..... 415/80, 81, 82, 83; 416/20 R; 60/325, 415; 138/42

[56] References Cited

U.S. PATENT DOCUMENTS

| | | | |
|---|---|---|---|
| 840,771 | 1/1907 | Jackson | 415/83 |
| 1,329,626 | 2/1920 | Oman | 415/80 |
| 2,596,276 | 5/1952 | Napoli | 415/80 X |
| 4,106,525 | 8/1978 | Currie et al. | 138/42 X |
| 4,110,981 | 9/1978 | Murphy | 60/415 |

*Primary Examiner*—Irwin C. Cohen

*Attorney, Agent, or Firm*—Stephenson & Boller

[57] ABSTRACT

A power plant having a fluid powered flywheel is disclosed. The flywheel comprises internal cylinder spaces which extend radially outwardly from a central region of the flywheel but which curve in a particular circumferential sense about the axis of the flywheel. Helical structures are disposed within the cylinder spaces to define respective helical flow paths through the cylinder spaces. Power fluid is delivered to a central region of the flywheel for entry into the cylinder spaces. Exhaust ports are provided to extend between the outer perimeter of the flywheel and the radially outer end of each cylinder space so that the exhausting fluid is jet discharged. Pressurized fluid is delivered from a reservoir containing a gas-over-liquid power source. An impeller driven by the flywheel collects the fluid discharged from the perimeter of the flywheel and returns it to the reservoir.

21 Claims, 3 Drawing Figures

POWER PLANT HAVING A FLUID POWERED FLYWHEEL

BACKGROUND AND SUMMARY OF THE INVENTION

This invention relates generally to power plants, and more specifically it relates to a power plant having a flywheel which is effective to convert the energy of power fluid into rotational energy for delivery by an output shaft. The flywheel is constructed with internal passages and fluid reaction surfaces on which the fluid power is effective.

Many sources attribute design of the world's first engine to the Roman inventor Hero. Hero's engine comprises a hollow body supported for rotation about an axis with power fluid (steam) being generated within the hollow body and discharged via jets at the periphery of the body. The jet discharge imparts rotation to the hollow body about its axis. The Hero engine is capable of developing great turning speed but with very little power. Attempts to develop this engine into a useful power plant must be regarded as generally unsuccessful as evidenced by lack of such power plants in commercial applications.

Other forms of power plants have been developed over the evolutionary history of such devices but many of these possess relatively low efficiencies in terms of horsepower output versus energy input. For example, the internal combustion engine which is used widely for various purposes, particularly in the automotive field, is a very inefficient source of energy utilization. While large forces are developed at the instant of combustion, they rapidly diminish on the piston's downstroke. Such engines are often water cooled and have elaborate cooling systems including radiators at which substantial amounts of waste heat are rejected. These engines also embody elaborate lubrication systems to minimize the effects of friction and wear. Furthermore, in order to minimize the effects of pollution from these engines to atmosphere, the engines are often deliberately operated at less than their already inefficient maximum efficiency. Additional pollution control equipment is associated with these engines to produce this result, and they are wasteful of fuel.

The present invention is directed to a new and improved power plant which offers important advantages and improvements over other power plants. The invention arises in part through the recognition that one of the problems with the Hero engine is that it lacks internal resistance, and that without such internal resistance it is impossible to develop great turning forces. The invention is capable of improved efficiencies of operation, and it is non-polluting as well.

The internal resistance of the engine of the present invention is provided by a new and unique arrangement. Further features which are embodied in the invention include factors relating to leverage, centrifugal force, jet propulsion, weight, inertia, stroke, and the power fluid.

One aspect of the invention relates to the provision of a flywheel journaled for rotation about an axis to drive an output shaft with power fluid being introduced into the flywheel. The flywheel is constructed and arranged with new and unique internal reaction surfaces upon which the fluid is effective.

In another aspect of the invention, the power fluid circuit is organized and arranged in a closed circuit between a reservoir chamber and the flywheel. Power fluid in the reservoir is maintained under pressure through the weight of fluid itself, and captive pressurized gas. The preferred form of reservoir comprises a gas-over-liquid system wherein liquid is the power fluid. The reservoir is closed so as to have the pressurized gas over the liquid thereby pressurizing the liquid to provide the power force. Maintenance of gas pressure can be by means of an air compressor or other device if needed.

The flywheel is journaled for rotation about its axis by a journal shaft containing a passage through which the pressurized liquid is conducted to the flywheel. The supply line from the reservoir to the journal shaft terminates in a rotary coupling at one end of the journal shaft so that the pressurized liquid can be supplied to the rotating flywheel.

The journal shaft comprises holes through its sidewall to communicate to internal cylinder chambers, or spaces, within the flywheel. These cylinder spaces extend radially outwardly from the central region of the flywheel but curve in a particular sense about the flywheel axis. The pressurized liquid enters the cylinders at the central region of the flywheel. Disposed within the cylinder chambers are helical structures which define helical paths through the chambers for the pressurized liquid. The helical structures have helical reaction surfaces against which the pressurized liquid is effective as it travels through the helical paths. Exhaust ports communicate exit points of the cylinders to the outer periphery of the flywheel, and they are disposed at an intersecting angle to the cylinder's sidewalls to produce a jet propulsion effect to the exiting liquid. The jets react against an outer casing surrounding the perimeter of the flywheel. This outer casing is part of an enclosed system which serves to collect the liquid which is jet-discharged from the periphery of the flywheel.

As part of the collection system, an impeller is coupled with the flywheel to be rotated by the flywheel. The impeller impels the collected liquid through a return line to the reservoir. Thus, a continuous circulation of liquid through the system is effective to power an output shaft coupled to the flywheel via which useful energy is delivered. The source of energy is the pressurized liquid which is kept pressurized by the gaseous pressure within the reservoir chamber.

The invention is of a non-polluting nature and of improved efficiency.

The foregoing features, advantages and benefits of the invention, along with additional ones, will be seen in the ensuing description and claims which should be considered in conjunction with the accompanying drawings. The drawings disclose a preferred embodiment of the invention according to the best mode contemplated at the present time in carrying out the invention.

DESCRIPTION OF THE PREFERRED EMBODIMENT

Figure 1:
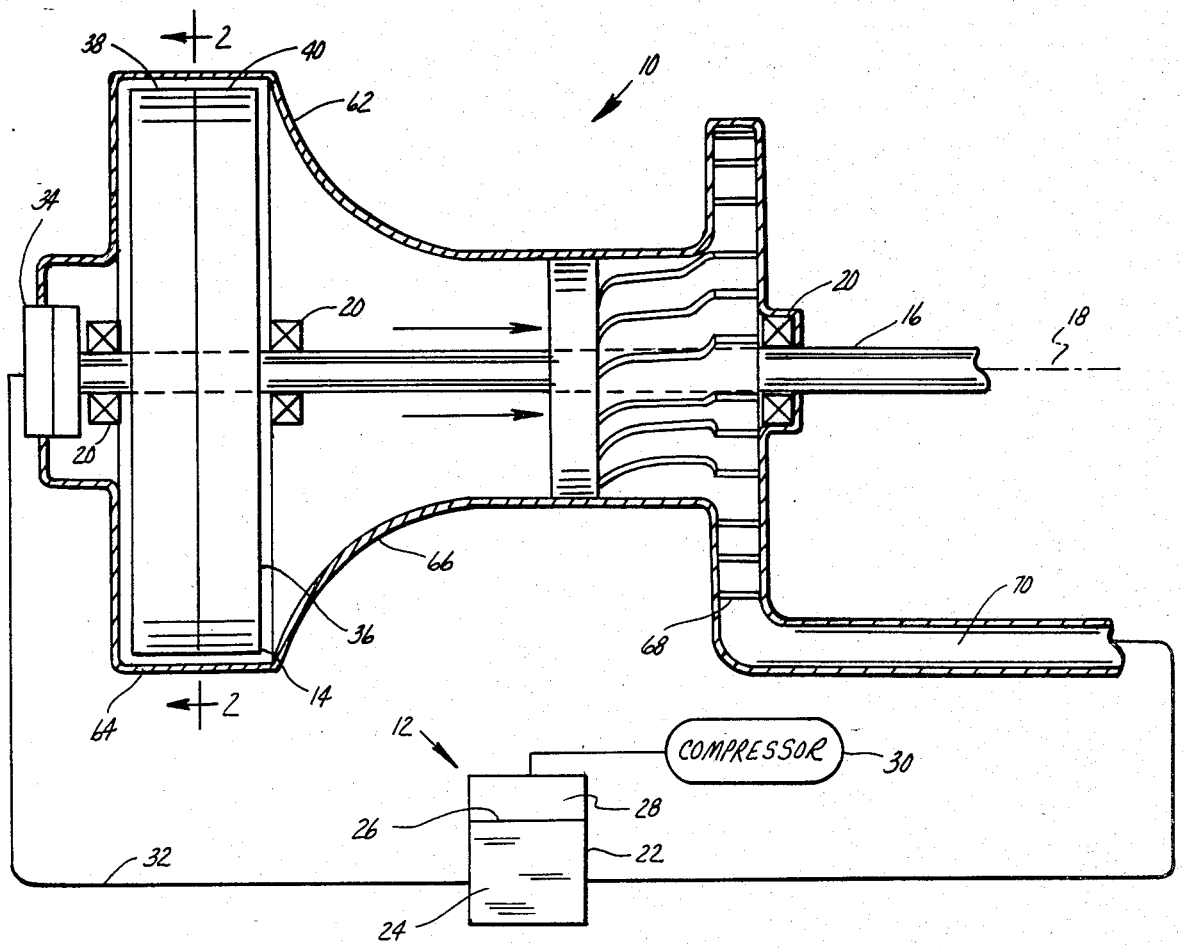
FIG. 1 is a view of a semi-schematic nature illustrating a power plant embodying principles of the present invention.

The drawings illustrate a power plant 10 embodying principles of the present invention. Looking first to FIG. 1 the reader will see that power plant 1 comprises a power fluid supply system 12, a flywheel 14, and a shaft 16. Briefly, the power fluid supply system supplies power to the flywheel causing the flywheel to rotate about its journal axis 18 thereby rotating shaft 16. The power plant serves to convert the energy of the power fluid into rotational energy which can be delivered by shaft 16 to any sort of utilization device requiring rotational input power. Since the power plant of this invention may be used to power different types of devices, no particular utilization device is shown coupled with shaft 16. FIG. 1 shows shaft 16 to constitute both the journal shaft for flywheel 14 and the output shaft for the power plant. The illustrated embodiment also shows both flywheel 14 and output shaft 16 coaxial with axis 18.

Also associated with the power plant in the illustrated embodiment of FIG. 1 is a collection and impeller system via which fluid is circulated through the power system and details of this system will be explained later on. For the moment, suffice it to say that flywheel 14 powers the impeller as well as output shaft 16.

FIG. 1 shows both flywheel and impeller mounted on shaft 16 which is journaled by suitable journal bearing supports which are indicated generally by the reference numerals 20. These journal bearing supports are conventional, and the illustrated arrangement is not intended to denote any particular configuration. The journal bearing supports will be designed in accordance with conventional procedures to suitably journal the shaft for the speed and load capabilities of the power plant. Also the one-piece showing of shaft 16 in FIG. 1 is not intended to limit possible constructions and arrangements, it being understood that multi-piece shafts suitably coupled could be used.

The power fluid supply system 12 includes a reservoir, or accumulator 22, which is of conventional construction. A suitable construction is a gas-over-liquid type system in which the power fluid for the power plant is a liquid 24, such as water, which fills the chamber 22 to a certain level indicated by the reference numeral 26. This leaves a headspace 28 for a gas under pressure, such as air. The pressure of the gas on the liquid is effective to pressurize the liquid so that it becomes a pressurized power fluid. It would also be possible to strategically position the reservoir in relation to the flywheel to take advantage of the hydraulic pressure due to weight of the liquid itself. This would be done by locating the reservoir such that the level 26 is located above the level of the point at which it is effective on the flywheel. Pressurized gas can be maintained by any suitable means, if necessary, such as by a compressor 30.

A liquid supply line 32 extends from the liquid zone of reservoir 22 to a rotary coupling 34 which is coaxially mounted at one end of the shaft adjacent flywheel 14. This coupling has a stationary part which connects to line 32 and a rotating part which connects to the rotating shaft. The reason for utilizing a rotary coupling 34 is that supply line 32 will be stationarily mounted adjacent the journaled rotating flywheel. The shaft 16 has an axial passage from coupling 34 to flywheel 14 through which the power fluid from line 32 passes to a central region of the flywheel. As will be seen from the ensuing detailed description, the power fluid is introduced into the central region of the flywheel and is conducted through internal structure of the flywheel to exhaust ports to rotate the flywheel and thereby develop power for the shaft.

Figure 2:
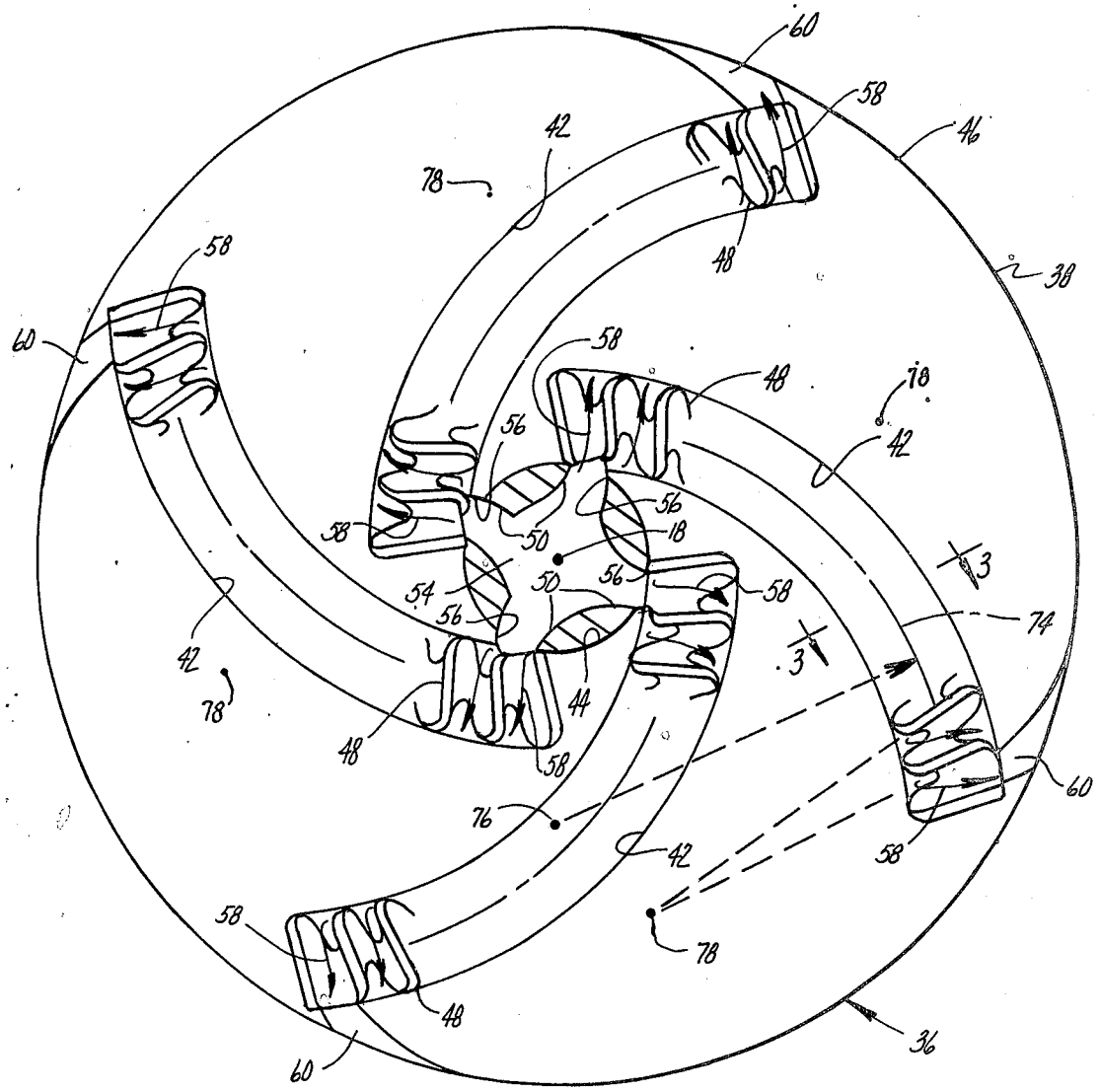
FIG. 2 is a transverse cross sectional view through a part of the power plant of FIG. 1 on an enlarged scale as taken in the direction of arrows 2—2 in FIG. 1.

It is therefore appropriate to turn to a detailed consideration of FIG. 2 which illustrates by way of example the internal construction of flywheel 14.

In FIG. 2 flywheel 14 is shown to comprise a circular disc body structure 36. The circular disc body structure may be constructed in various ways. One way is by two separate pieces such as 38 and 40 (see FIG. 1) which are both circular disc-like elements which are joined together at confronting faces. The two piece construction of the flywheel body allows the flywheel body to be fabricated with internal structure which is illustrated in FIG. 2. This internal structure comprises a series of cylinder chambers, or spaces 42 which are organized and arranged in a new and unique manner. These cylinder spaces extend radially outwardly but curve in a particular circumferential sense about axis 18.

The disc-like elements 38 and 40 are arranged and constructed to comprise, when assembled together, a central circular bore 44 and a circular outer perimeter 46. The disc-like elements are solid except for internal cavities which provide for the cylinder spaces 42.

Figure 3:
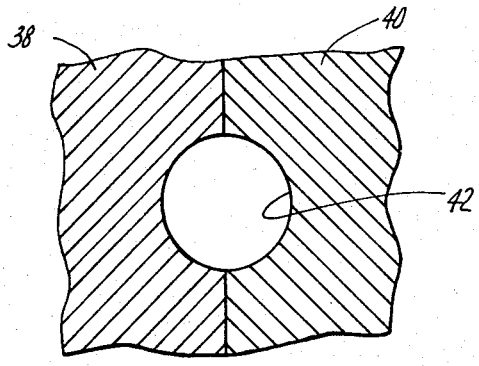
FIG. 3 is a cross section taken in the direction of arrows 3—3 in FIG. 2 with a portion of the assembly removed.

Each cylinder space 42 has a substantially circular transverse cross section as shown in FIG. 3. The confronting circular faces of the disc-like elements longitudinally bisect all cylinder spaces 42 so that one half of each cylinder space is defined by one of the two discs and the opposite half by the other disc. When the two discs are assembled together with their confronting faces in abutment, the cylinder spaces are cooperatively defined between them. Before assembly of the two discs however, helical structures 48 for providing internal resistance are disposed within the cylinder spaces. The exact details of these helical structures will be explained shortly.

Shaft 16 is provided with a series of apertures 50 which carry the power fluid from passage 54 in the shaft to the cylinder spaces 42. Apertures 50 extend radially through the wall of the shaft so that each aperture extends toward a corresponding cylinder space. As can be seen in the embodiment of FIG. 2 there are four such apertures 50, each of which is associated with a corresponding one of four cylinder spaces 42, each aperture and cylinder space being arranged 90° apart about axis 18 from each adjacent aperture and cylinder space.

It will be observed that each cylinder space 42 is arranged such that a portion of its sidewall faces the corresponding aperture 50. An entrance opening 56 into the corresponding cylinder space 42 is provided in the flywheel body between each aperture 50 and the sidewall of the cylinder space. Thus, power fluid introduced through the axis of the power plant via passage 54 to the central region of the flywheel is conducted radially through each aperture 50 and opening 56 into the corresponding cylinder space. The aperture 50 and entrance openings 56 may be considered as intake ports for the cylinder spaces.

Each cylinder space 42 in cooperation with the corresponding helical structure 48 disposed therein defines a helical path 58 for power fluid through each cylinder space. The helical structures are arranged and constructed such that each comprises a helical reaction surface extending along the length of the cylinder space on which the power fluid is effective. Thus, the power fluid, after being introduced into a cylinder space, will endeavor to move radially outwardly of axis 18 along the helical path for that cylinder space. In doing so it is effective on the helical reaction surface to impart reaction force along the entire developed length of the helix.

The flywheel body structure is further provided with exit, or exhaust, ports 60 which serve to communicate the exit point of power fluid from each cylinder space to the radially outer periphery 46 of the flywheel body structure. As can be seen in FIG. 2 each exhaust port has a curved shape which curves in the opposite sense from the curvature of cylinder spaces 42 about axis 18. Each exhaust port has a radially inner end which intersects the sidewall of the corresponding cylinder space at the point of exit of the power fluid from the cylinder space and each exhaust port has a radially outer end at the outer perimeter of the flywheel body structure.

As explained above, the illustrated flywheel is constructed with one half of each cylinder space 42 provided as a cavity in one of the disc-like elements 38, 40 and the other half of each cylinder space being provided in the other element. The principal reason for doing this is so that the helical structures 48 can be assembled into the cavities before the two disc-like elements 38, 40 are subsequently assembled together. The preferred construction also has the intake ports constructed and arranged such that the power fluid tangentially enters the initial convolution of each helical path at the point of entry to the corresponding cylinder chamber. This may involve the apertures 50 and entrance openings 56 being axially offset to one side (such as to the right as viewed in FIG. 1) of the plane of the confronting faces of the two disc-like elements in the assembled flywheel. Similarly, because the exhaust ports 60 are arranged to tangentially intercept the final convolution of the helical path through each cylinder, these too may be axially offset from the plane of the confronting faces of the two disc-like elements.

Elements 38 and 40 may be constructed and arranged to provide for this possibility. In other words, rather than the entrance openings 56 and exhaust ports 60 being defined such that one half of each is in one element and the other half in the other element, they instead may be asymmetrically arranged with respect to the plane of the confronting faces of the two elements. In this regard, they may still be cooperatively defined by respective cavity portions in the two elements but these cavity portions may not be symmetrical with respect to the plane of the confronting faces of the two elements. Moreover, it is entirely possible for them to be sufficiently asymmetrical relative to the plane of the confronting faces of the two elements that they need not be cooperatively defined by the two elements, but rather instead be contained entirely in only one of the elements. Any given embodiment of the invention will depend upon the relative sizes and dimensions involved.

After it has passed through the cylinder spaces, power fluid continues through the exhaust ports to be jet-discharged at the outer periphery of the flywheel. The illustrated construction and arrangement of the exhaust ports produces a jet effect.

Returning to FIG. 1 it can be seen that the flywheel is enclosed by a structure 62 which includes a portion 64 surrounding the periphery of the flywheel. The enclosure has a narrowing taper 66 from the outer periphery of the flywheel such that the fluid discharged from the flywheel is funneled axially to the right as viewed in FIG. 1. At the right hand end of the enclosure there is disposed a bladed impeller 68 which is affixed to shaft 16. Thus, rotation of the flywheel is effective to rotate the impeller. The impeller thereby impels the collected fluid through a return conduit 70 back to reservoir 22.

The component parts of the flywheel may comprise suitable castings made to the particular shapes involved. These shapes may be finished through conventional machining and finishing procedures. Thus, the finished flywheel may comprise a structure having an appreciable mass so as to similarly have an appreciable moment of inertia. This will contribute to the power delivery capabilities of the power plant. In the completed assembly, the confronting faces of the two disc-like elements are suitably joined together so as to prevent leakage from between the confronting faces.

The operation of the power plant may then be briefly summarized as follows. The pressurized gas in reservoir 22 pressurizes the liquid. The pressurized liquid is delivered via supply line 32 and through the rotary coupling 34 to passage 54 through shaft 16 to the central region of the flywheel. The liquid then passes through apertures 50 and entrance openings 56 into the cylinder spaces. The alignment of the intake ports constituted by apertures 50 and entrance openings 56 with the first convolution of each helical flow path through the corresponding cylinder space facilitates the introduction of liquid into the cylinder spaces with the liquid passing helically through each cylinder space by virtue of the helical structure disposed therein. As it passes through the chambers, the power fluid exerts a resultant force on the helical reaction surfaces. The exhaust ports 60 align with the final convolution of each of the helical paths so that the exiting fluid is directed in a jet discharge from the periphery of the flywheel against the surrounding structure of the casing. The liquid is collected by the impeller and returned through the return line to the reservoir. A suitable check valve may be included in the return line to prevent reverse flow from the reservoir.

The invention has the advantages enumerated above in that it is of improved efficiency and of a non-polluting character. It is also effective in that the power fluid is effective along the length of each helical flow path through a cylinder with resultant force being developed over the fully developed length of each the helical convolutions. The arrangement is also promotive of centrifugal force action between the pressure fluid and reaction surfaces. It is effective from the standpoint of leverage because force is developed along the length of each helical convolution. Thus, with the invention, improved efficiency is obtained with the capability that useful amounts of power can be delivered by the rotating shaft.

The curved nature of the cylinders is advantageous for several reasons. For one, it can provide a longer effective active length through a cylinder for a given diameter of flywheel. For another, the forces which are exerted by the fluid on the reaction surfaces are distributed not along straight radials but rather along spiral convolutions. This promotes a better development of force on the flywheel body structure. Moreover, it allows for the inclusions of the jet discharge effect created by the exhaust ports intersecting the outer ends of the cylinders as described above.

The invention may be practiced through the use of application of conventional principles of engineering and physics to size the components appropriately for any given power application. For example, while four cylinder spaces have been shown, each extending about 90° about axis 18, other cylinder configurations may be used. Other materials than casting could also be used for the flywheel construction.

The disclosed embodiment comprises the curved longitudinal axis 74 of each cylinder space being a circular arc of about 90° centered at a point 76, with points 76 being spaced apart 90° on a common circle concentric with axis 18. Each helical structure 48 has its convolutions inclined such that tangent lines to the same point on each convolution interact at a common point 78. Thus, FIG. 2 shows four such points 78, one for each cylinder, which are spaced 90° apart on a common circle concentric with axis 18.

While a preferred embodiment of the invention has been disclosed, it will be appreciated that principles are applicable to other embodiments.

What is claimed is:

1. A power plant comprising a source of power fluid, a rotary output shaft, and means for converting the energy of the power fluid into rotational energy for delivery by said output shaft comprising a flywheel journaled for rotation about an axis, means for introducing power fluid to a central region of said flywheel, said flywheel comprising a body, means defining a plurality of cylinder spaces within said body spaced circumferentially about said axis, an intake port for communicating each cylinder space to the power fluid at the central region of said flywheel, an exhaust port for each cylinder space via which power fluid is exhausted, each exhaust port being spaced radially outwardly of the corresponding intake port and oriented to produce a jet effect with resulting flywheel rotation when power fluid is exhausted thereform, said cylinder spaces having curved longitudinal axes curving in the same sense about said first axis, and helical structure with a curved longitudinal axis disposed within each cylinder space and extending continuously from a point open to said intake port to a point open to said exhaust port to define a helical flow path therethrough for the power fluid, said helical structure comprising a helical reaction surface providing internal resistance against which the power fluid is effective as it passes through the cylinder space.

2. A power plant as set forth in claim 1 in which said flywheel is journaled on a shaft having a passage through which power fluid is conducted to the central region of said flywheel, said intake ports extending from said passage, each cylinder space having an entrance at the corresponding intake port, each intake port extending radially of said first axis to align with an entrance convolution of the helical flow path through the corresponding cylinder space.

3. A power plant as set forth in claim 2 in which each exhaust port extends radially inwardly from the outer periphery of said flywheel to align with an exit convolution of the corresponding helical flow path.

4. A power plant as set forth in claim 3 in which said each exhaust port intersects the sidewall of the corresponding cylinder space at the corresponding exit convolution.

5. A power plant as set forth in claim 4 in which said exit ports curve radially outwardly in the opposite circumferential sense from that of said cylinder spaces.

6. A power plant as set forth in claim 1 in which said flywheel is journaled on a shaft having a passage through which power fluid is conducted to the central region of said flywheel, said shaft being in fluid communication with said intake ports for delivery of power fluid via said passage through said intake ports to the helical flow paths, said exhaust ports intersecting the sidewalls of said cylinder spaces at points of exit of power fluid from said cylinder spaces after having passed through the helical flow paths, each exhaust port having a curvature which extends radially outwardly in the opposite circumferential sense from that of said cylinder spaces.

7. A power plant as set forth in claim 1 in which said intake ports communicate with the respective cylinder spaces at locations which are spaced radially outwardly of said first axis, the helical flow paths beginning at the point at which said intake ports communicate with said cylinder spaces.

8. A power plant as set forth in claim 7 in which the ends of the helical flow paths are spaced radially inwardly from the outer perimeter of said flywheel, and said exhaust ports extend from said ends of the helical flow paths to the outer perimeter of said flywheel, said exhaust ports intercepting the sidewalls of said cylinder spaces.

9. A power plant as set forth in claim 1 in which said cylinder spaces are uniformly circumferentially spaced about said first axis and are of substantially the same dimensions.

10. A power plant as set forth in claim 1 in which said source of power fluid comprises a fluid reservoir and a supply line from said fluid reservoir to said flywheel which includes a rotary joint coupling to the journalled flywheel.

11. A power plant as set forth in claim 10 in which said source of fluid power and said flywheel are coupled in a closed circuit for power fluid in which fluid exiting said exhaust ports is collected and recirculated back to the reservoir.

12. A power plant as set forth in claim 11 in which said closed circuit comprises a collection chamber having a portion disposed around the periphery of said flywheel and an impeller drive driven by said flywheel to collect and impel fluid through a return line to the reservoir.

13. A power plant as set forth in claim 12 in which said reservoir comprises a gas-over-liquid system.

14. A power plant as set forth in claim 13 including means to maintain gas pressure within said reservoir.

15. A power plant as set forth in claim 1 in which said output shaft is coaxial with the journal mounting of said flywheel so as to be coaxial with said first axis.

16. In a power plant, a flywheel for converting fluid power into rotational energy comprising flywheel body structure adapted for rotation about an axis, at least one cylinder space defined by said flywheel body structure, an intake port in said flywheel body structure providing communication between a point of entry of power fluid to said flywheel and an entrance to said cylinder space which entrance is spaced radially outwardly of said axis, said cylinder space having a curved longitudinal axis curving radially outwardly in a given circumferential sense about said first axis, an exhaust port communicating with said cylinder space at a location spaced radially outwardly of said entrance, said exhaust port being oriented to produce a jet effect with resulting flywheel rotation when power fluid is exhausted therefrom, and helical structure disposed in said cylinder space and extending continuously from a point open to said entrance to a point open to said exhaust port to define a helical flow path through said cylinder space, said helical structure comprising a helical reaction surface providing internal resistance against which power fluid passing through the cylinder space is effective.

17. In a power plant as set forth in claim 16, said flywheel comprising a plurality of such cylinder spaces uniformly distributed around the axis of said flywheel body structure, a corresponding intake port, exhaust port, and helical structure for each cylinder space, said cylinder spaces, said intake ports, said exhaust ports, and said helical structures being substantially identical.

18. In a power plant as set forth in claim 17, said intake ports being provided in a journal shaft for said flywheel.

19. In a power plant as set forth in claim 18, for each cylinder space the intake and exhaust ports' respective points of communication with the cylinder space being spaced angularly apart about said axis in angular amount approximately equal to 360° divided by the number of such cylinder spaces.

20. In a power plant as set forth in claim 19, each exhaust port having a longitudinal extent and intersecting the corresponding cylinder space at a location spaced radially inwardly of the outer perimeter of said flywheel body structure, each exhaust port extending between such intersection and the outer perimeter of said flywheel body structure such that the point at which the exhaust port intersects the outer perimeter of said flywheel body structure is disposed circumferentially between the intersection of the exhaust port with the cylinder space and the intersection of the intake port with the cylinder space.

21. In a power plant as set forth in claim 16, each such cylinder space having its axis as a circular arc centered at a given point spaced from said axis of rotation, and the corresponding helical structure having its convolutions inclined such that tangent lines to the same point on each convolution intersect at a common point which is spaced from said axis of rotation farther than said given point.

* * * * *